US006389854B1

(12) United States Patent
Huang

(10) Patent No.: US 6,389,854 B1
(45) Date of Patent: May 21, 2002

(54) COMPUTER LOCK

(76) Inventor: Dennis Huang, 5F, No. 10, Lane 9, Ningpo E. St., Taipei (TW)

( * ) Notice: Subject to any disclaimer, the term of this patent is extended or adjusted under 35 U.S.C. 154(b) by 0 days.

(21) Appl. No.: 09/741,175

(22) Filed: Dec. 21, 2000

(51) Int. Cl.[7] ..... E05B 69/100

(52) U.S. Cl. ..... 70/58; 70/14; 70/49; 70/164; 70/DIG. 49

(58) Field of Search ..... 70/14, 30, 49, 70/57, 58, 423–428, DIG. 49

(56) References Cited

U.S. PATENT DOCUMENTS 934,928 A * 9/1909 Michel ..... 70/423 X
2,383,397 A * 8/1945 Lofqwist ..... 70/424
3,772,645 A * 11/1973 Odenz et al. ..... 70/49 X
3,879,721 A * 4/1975 Yereance ..... 70/49 X
4,057,986 A * 11/1977 Zolke et al. ..... 70/14 X
4,462,233 A * 7/1984 Horetzke ..... 70/428
4,776,188 A * 10/1988 Dalaba et al. ..... 70/49
5,390,514 A * 2/1995 Harmon ..... 70/14
5,400,622 A * 3/1995 Harmon ..... 70/14
5,786,759 A * 7/1998 Ling ..... 70/30 X
5,787,738 A * 8/1998 Brandt et al. ..... 70/58
5,787,739 A * 8/1998 Derman ..... 70/58
5,907,962 A * 6/1999 Smithson et al. ..... 70/58
6,038,891 A * 3/2000 Zeren et al. ..... 70/58
6,112,561 A * 9/2000 Carl ..... 70/58

FOREIGN PATENT DOCUMENTS

GB 2240578 * 8/1991 ..... 70/30

* cited by examiner

*Primary Examiner*—Suzanne Dino Barrett
(74) *Attorney, Agent, or Firm*—Bacon & Thomas

(57) ABSTRACT

A computer lock includes a first locking plate, the first locking plate including a handle, a hook rod, and a coupling structure connected between the handle of the first locking plate and the hook rod ofthe first locking plate, the handle of the first locking plate having a locating hole, the hook rod of the first locking plate having a free end terminating in a hooked portions; a second locking plate, the second locking plate including a handle, a hook rod, and a pivot hole disposed between the handle of the second locking plate and the hook rod of the second locking plate and pivoted to the coupling structure of the first locking plate, the handle of the second locking plate having a locating hole, the hook rod of the first locking plate having a free end terminating in a hooked portion; and a retainer member adapted for insertion into the locating hole of the first locking plate and the locating hole of the second locking plate.

2 Claims, 3 Drawing Sheets

COMPUTER LOCK

BACKGROUND OF THE INVENTION

1. Field of the Invention

The present invention relates to a lock and, more particularly, to a computer hardware lock.

2. Description of Related Art

Regular notebook computer or portable computer mainframes are commonly provided with a security slot for stealing protection. The user can fasten a computer lock to the security slot to lock the computer device. However, conventional computer locks for this purpose are commonly complicated and expensive.

Therefore, it is desirable to provide a simple structure of computer lock.

SUMMARY OF THE INVENTION

The main object of the present invention is to provide a computer lock, which is inexpensive and, has a simple structure. Another object of the present invention is to provide a computer lock that can be used with a burglar alarm.

To achieve these and other objects of the present invention, the computer lock includes a first locking plate, a second locking plate, and a retainer member. The first locking plate comprises a handle, a hook rod, and a coupling structure connected between the handle of the first locking plate and the hook rod of the first locking plate. The handle of the first locking plate has a locating hole. The hook rod of the first locking plate has a free end terminating in a hooked portion. The second locking plate comprises a handle, a hook rod, and a pivot hole disposed between the handle of the second locking plate and the hook rod of the second locking plate and pivoted to the coupling structure of the first locking plate. The handle of the second locking plate has a locating hole. The hook rod of the first locking plate has a free end terminating in a hooked portion.

Simply speaking, the first locking plate and the second locking plate are coupled together like a pair of scissors, and their action is similar to a scissor action. The first locking plate and the second locking plate can be turned relative to each other, i.e., the second locking plate is turned about a pivot at the first locking plate so that the hooked portions of the locking plates can be turned toward each other, or turned asides. When the hooked portions of the locking plates are closely attached to each other, they can be inserted into the security slot of a notebook computer or portable computer hardware device. When turning the hooked portions of the locking plates asides in reversed directions after their insertion into the security slot, the hooked portions of the locking plates are hooked in the security slot.

According to the design of the present invention, when the hooked portions of the locking plates are turned asides in reversed directions and hooked in the security slot, the locating holes of the locking plates are axially aligned, and the retainer member is inserted through the locating holes of the locking plates to hold the locking plates in the locking position. The retainer member can be used with a combination lock or padlock for locking the notebook computer or computer hardware device to a post, rail, or table. The retainer member can also be used with a burglar alarm that alarms when somebody steals the notebook computer or computer hardware device. The connection of the retainer member to a combination lock or padlock, or a burglar alarm can easily be achieved by conventional techniques.

The computer lock of the present invention can also be used with a radio burglar alarm, which is comprised of a transmitter unit for carrying by the user, and a receiver unit for installing in the computer lock of the present invention. If the receiver unit receives no signal from the transmitter unit (for example, the user leaves from the computer over 10 meters), the receiver unit immediately gives an audio alarm or SOS signal. If a burglar cuts off the retainer member, the receiver unit immediately detects a vibration or broken circuit signal and then gives an audio alarm or SOS signal.

Other objects, advantages, and novel features of the invention will become more apparent from the following detailed description when taken in conjunction with the accompanying drawings.

BRIEF DESCRIPTION OF THE DRAWINGS

FIG. 2A is an enlarged view of a part of FIG. 2 showing the structure of the screw nut.

DETAILED DESCRIPTION OF THE PREFERRED EMBODIMENT

Figure 1:
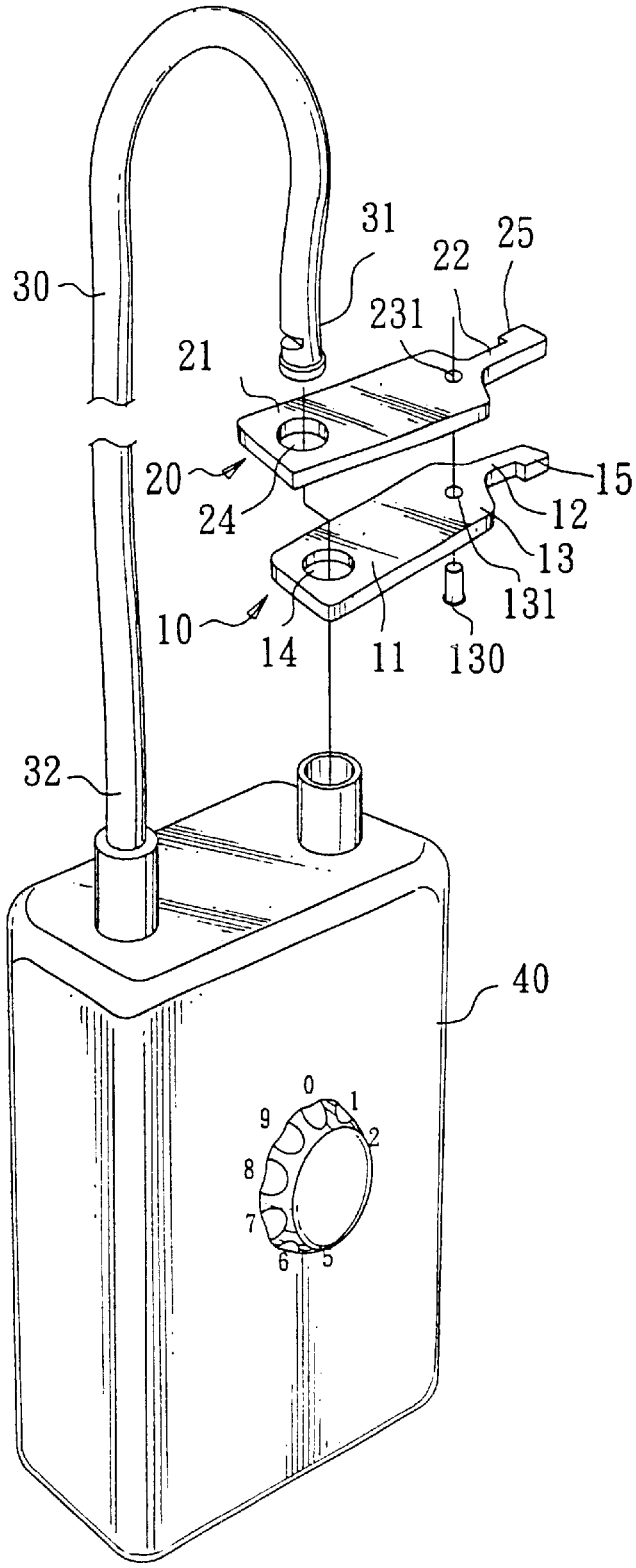
FIG. 1 is an exploded view of a computer lock (combined with a combination lock) according to a first embodiment of the present invention.

With reference to FIG. 1, a computer lock arrangement in accordance with one embodiment of the present invention is shown comprised of a first locking plate 10, a second locking plate 20, and a retainer member 30.

The first locking plate 10 comprises a handle 11, a hook rod 12, and a coupling structure 13. The coupling structure 13 is connected between the handle 11 and the hook rod 12. As illustrated in FIG. 1, the coupling structure 13 comprises an axle hole 131 and a pivot 130. Alternatively, the pivot 130 can be formed integral with the axle hole 131, forming an integrated coupling structure 13. The handle 11 of the first locking plate 10 has a locating hole 14. The hook rod 12 of the first locking plate 10 has a free end terminating in a hooked portion 15.

The second locking plate 20 comprises a handle 21, a hook rod 22, and an axle hole 231 provided between the handle 21 and the hook rod 22. The axle hole 231 is coupled to the pivot 130 of the first locking plate 10, enabling the second locking plate 20 to be turned about the pivot 130. The handle 21 of the second locking plate 20 has a locating hole 24 corresponding to the locating hole 14 of the handle 11 of the first locking plate 10. The hook rod 22 of the second locking plate 20 has a free end terminating in a hooked portion 25.

The retainer member 30 is adapted for inserting through the locating hole 14 of the handle 11 of the first locking plate 10 and the locating hole 24 of the handle 21 of the second locking plate 20. When the first locking plate 10 and the second locking plate 20 are attached together and the locating hole 14 of the handle 11 of the first locking plate 10 and the locating hole 24 of the handle 21 of the second locking plate 20 are axially aligned, the hooked portion 15 of the first locking plate 10 and the hooked portion 25 of the second locking plate 20 are turned aside in reversed directions. Therefore, when inserting the retainer member 30 through the locating hole 14 of the handle 11 of the first locking plate 10 and the locating hole 24 of the handle 21 of the second locking plate 20, the first locking plate 10 and the second locking plate 20 are secured together, causing the hooked portions 15 and 25 to be maintained turned aside in reversed directions.

Referring to FIG. 1 again, the first end 31 and second end 32 of the retainer member 30 are respectively connected to a combination lock 40. According to this embodiment, the retainer member 30 is a metal cord member used with the combination lock 40 to lock a notebook computer (not shown) to a post, rail, table, etc.

Figure 2:
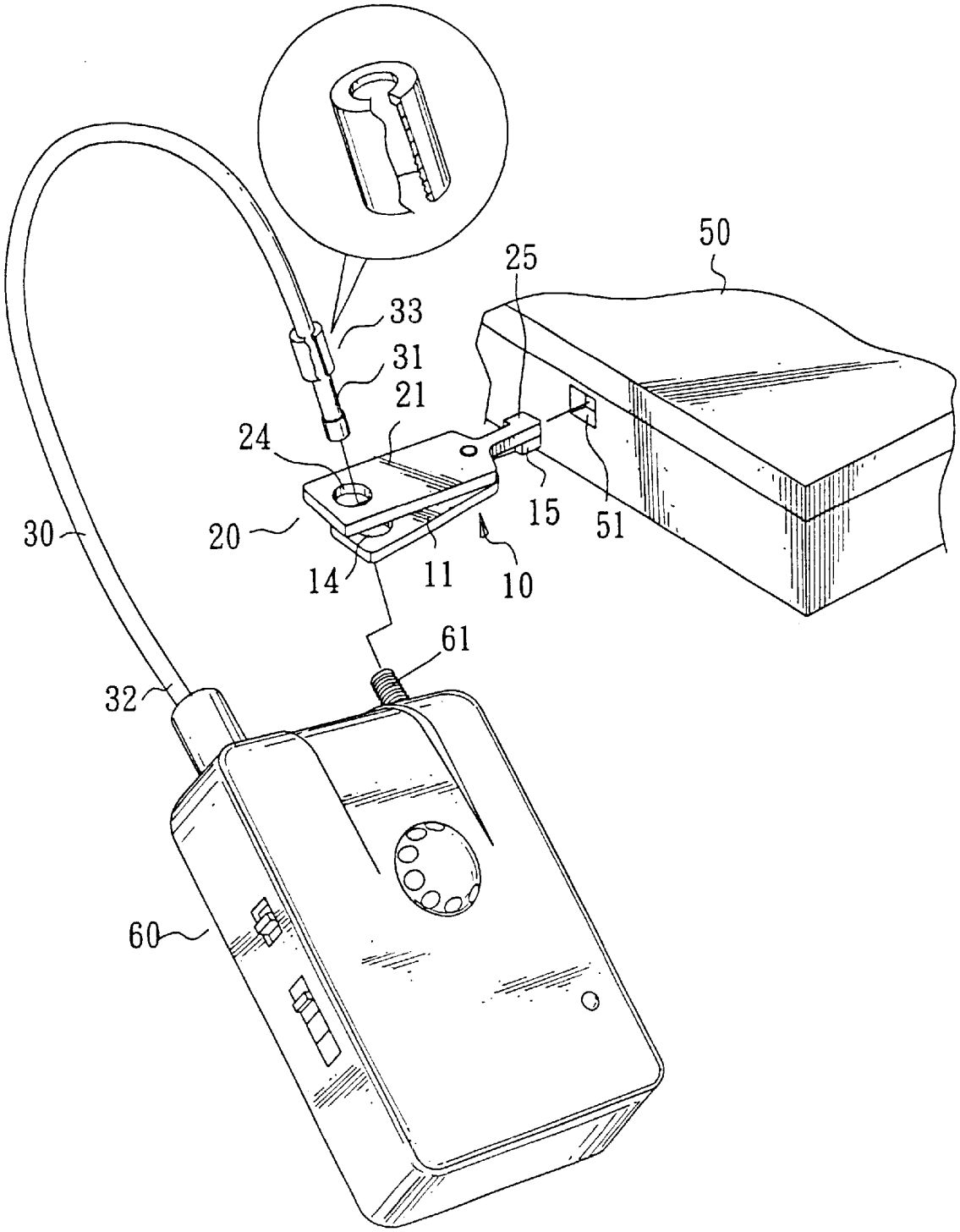
FIG. 2 illustrates the use of a computer lock with a burglar alarm in a notebook computer according to a second embodiment of the present invention.
Figure 3:
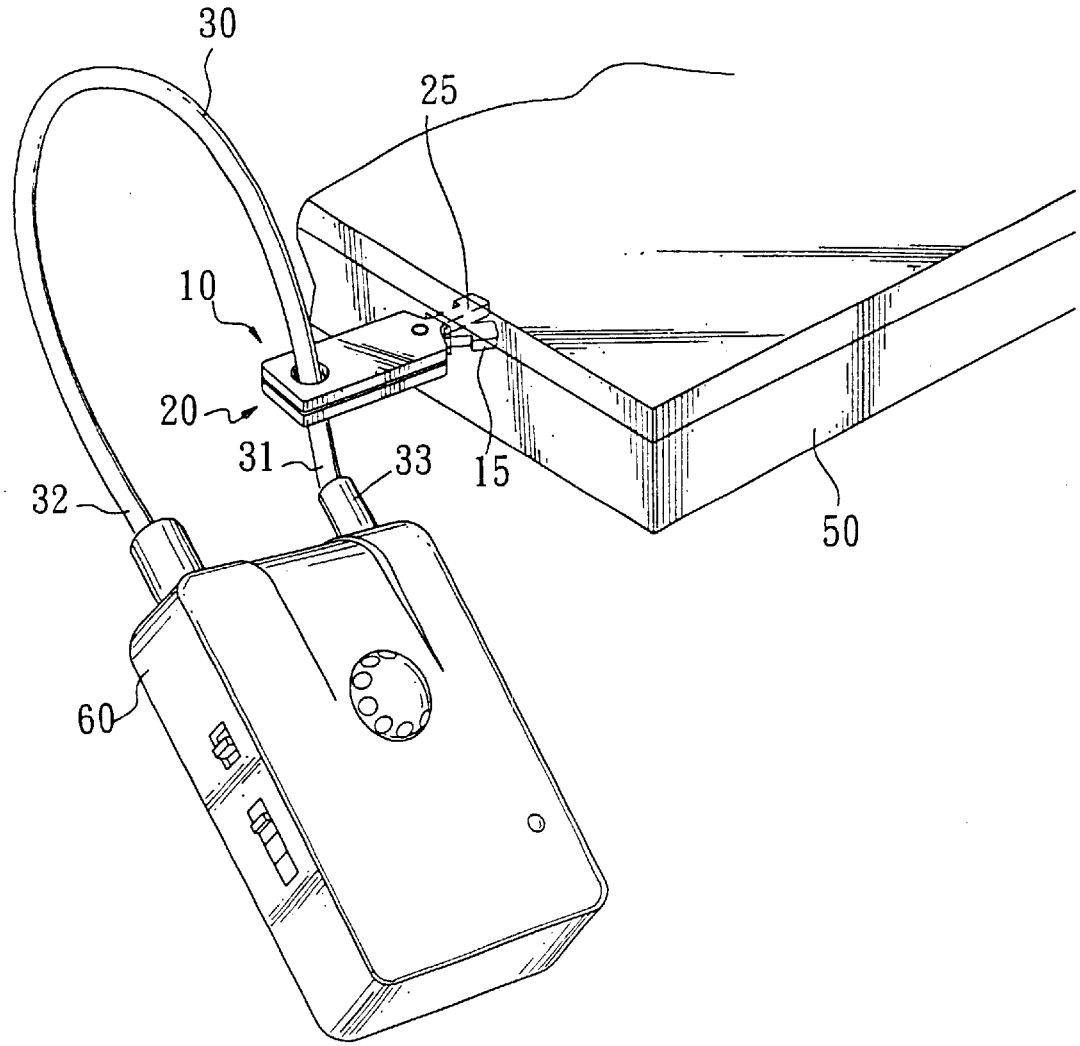
FIG. 3 illustrates the locking plates hooked in the security slot of the notebook computer according to the second embodiment of the present invention.

Referring to FIGS. 2 and 3, when locking the notebook computer 50, the first locking plate 10 and the second locking plate 20 are attached together, enabling the hooked portions 15 and 25 to be closely attached together, and then the hooked portions 15 and 25 are inserted into the security slot 51 of the notebook computer 50, and then the first locking plate 10 and the second locking plate 20 are moved relative to each other to align the locating holes 14 and 24, so that the hooked portions 15 and 25 are turned asides in reversed directions and hooked in a respective part of the notebook computer 50 inside the security slot 51, and then the retainer member 30 is inserted through the locating holes 14 and 24 to keep the locking plates 10 and 20 in the locking position. The first end 31 of the retainer member 30 is provided with a screw nut 33 adapted for threading onto a screw rod 61 at a burglar alarm 60, and the second end 32 of the retainer member 30 is fixedly connected to the burglar alarm 60.

Although the present invention has been explained in relation to its preferred embodiment, it is to be understood that many other possible modifications and variations can be made without departing from the spirit and scope of the invention as hereinafter claimed.

What is claimed is:

1. A computer lock comprising:

A first locking plate, said first locking plate comprising a handle, a hook rod, and a coupling structure connected between the handle of said first locking plate and the hook rod of said first locking plate, the handle of said first locking plate comprising a locating hole, the hook rod of said first locking plate having a free end terminating in a hooked portion;

a second locking plate, said second locking plate comprising a handle, a hook rod, and a pivot hole disposed between the handle of said second locking plate and the hook rod of said second locking plate and pivoted to the coupling structure of said first locking plate, the handle of said second locking plate comprising a locating hole, the hook rod of said first locking plate having a free end terminating in a hooked portion; and a retainer member adapted for insertion into the locating hole of said first locking plate and the locating hole of said second locking plate, wherein when said first locking plate and said second locking plate are attached together and the locating holes of said first locking plate and said second locking plate are axially aligned, the hooked portions of said first locking plate and said second locking plate are turned asides in reversed directions, and wherein said retainer member is a metal cord having a first end and a second end respectively connected to a burglar alarm, the first end of said retainer member being fitted with a screw nut adapted for threading onto a screw rod at said burglar alarm.

2. The computer lock as claimed in claim 1, wherein the coupling structure of said first locking plate comprises a pivot hole and a pivot fastened to the pivot hole of said coupling structure of said first locking plate and the pivot hole of said second locking plate for enabling said second locking plate to be turned about said pivot.

* * * * *